US007012373B2

(12) United States Patent
Ho

(10) Patent No.: US 7,012,373 B2
(45) Date of Patent: Mar. 14, 2006

(54) ELECTRONIC ENERGY-SAVING FLUORESCENT LAMP OF ULTRA-SHORT CHAYOTE-SHAPED COMPACT TYPE

(75) Inventor: Run Lin Ho, Xiamen (CN)

(73) Assignee: Aero-Tech Light Bulb Co., Shaumburg, IL (US)

( * ) Notice: Subject to any disclaimer, the term of this patent is extended or adjusted under 35 U.S.C. 154(b) by 147 days.

(21) Appl. No.: 10/799,466

(22) Filed: Mar. 12, 2004

(65) Prior Publication Data

US 2004/0239254 A1 Dec. 2, 2004

(30) Foreign Application Priority Data

May 26, 2003 (CN) ..... 3222136 U

(51) Int. Cl.

| | |
|---|---|
| ***H01J 17/16*** | (2006.01) |
| ***H01J 61/30*** | (2006.01) |
| ***H01J 5/48*** | (2006.01) |
| ***H01J 9/20*** | (2006.01) |

(52) U.S. Cl. ..... 313/634; 313/493; 313/318.12; 445/22

(58) Field of Classification Search ..... 313/634, 313/493

See application file for complete search history.

(56) References Cited

U.S. PATENT DOCUMENTS 5,552,666 A * 9/1996 Shea et al. ..... 313/493
5,672,932 A * 9/1997 Goldman ..... 313/318.01

OTHER PUBLICATIONS

DURA Lamp, product literature, Jan., 2004.
GE Lighting Lamp Products Catalog 2004, pp. 5-3, 5-10, and 5-11, Jan., 2004.
MaxLite™ Brochure, prior to Jun., 2004.
MaxLite™ Brochure, Jun., 2004.
Philips Lighting Company, Lamp Specification & Application Guide 2004, pp. 13 and 43-54, Jan., 2004.
Sylvania, Lamp and Ballast Product Catalog 2004, pp. 103 and 111-112, Jan., 2004.
Technical Consumer Products, Inc., Commercial/Industrial Lamps & Fixtures, Brochure, Feb., 2004.
Westinghouse 2002 Lamp Specification Guide, pp. 55-56, Jan., 2002.

* cited by examiner

*Primary Examiner*—Mariceli Santiago
*Assistant Examiner*—Elizabeth Rielley
(74) *Attorney, Agent, or Firm*—Bell, Boyd & Lloyd, LLC

(57) ABSTRACT

An ultra-short Chayote-like compact electronic energy-saving fluorescent lamp comprising, in one embodiment, a base, an upper cover, a lower cover, a luminous tube of the Chayote-like lamp and an electronic ballast. The luminous tube of the Chayote-like lamp is formed by bending several U-shaped unit luminous tubes at certain curvature into finger-shaped luminous tubes, and by connecting and assembling the finger-shaped unit luminous tubes according to the shape of a Chayote using the method of bridge connection. The Chayote-like lamp has the advantages of ultra-short structure, higher luminous efficiency, higher reliability and other benefits. The Chayote-like lamp of the present invention can be used for general illumination, although it is preferably used in combination with the lamps and lanterns having covers.

21 Claims, 6 Drawing Sheets

FIG. 1A
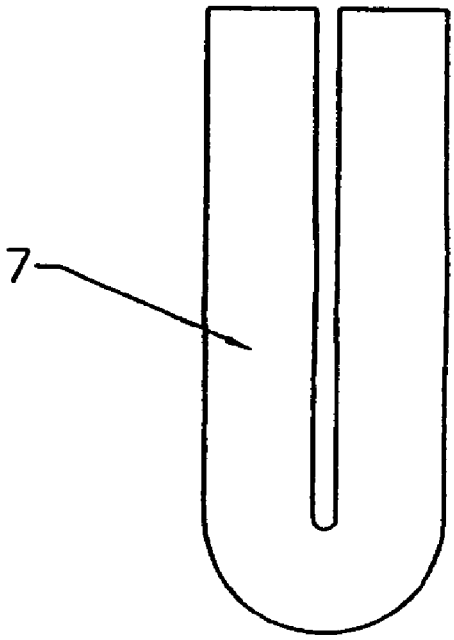
FIG. 1B
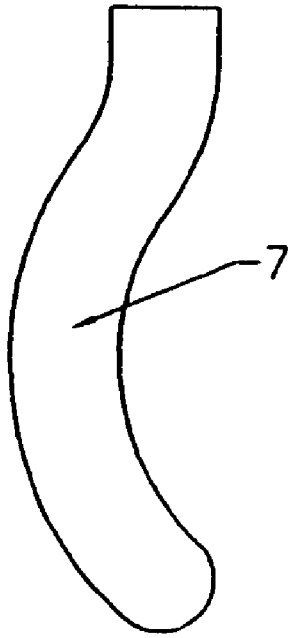
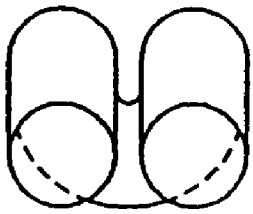
FIG. 1C

FIG. 2A
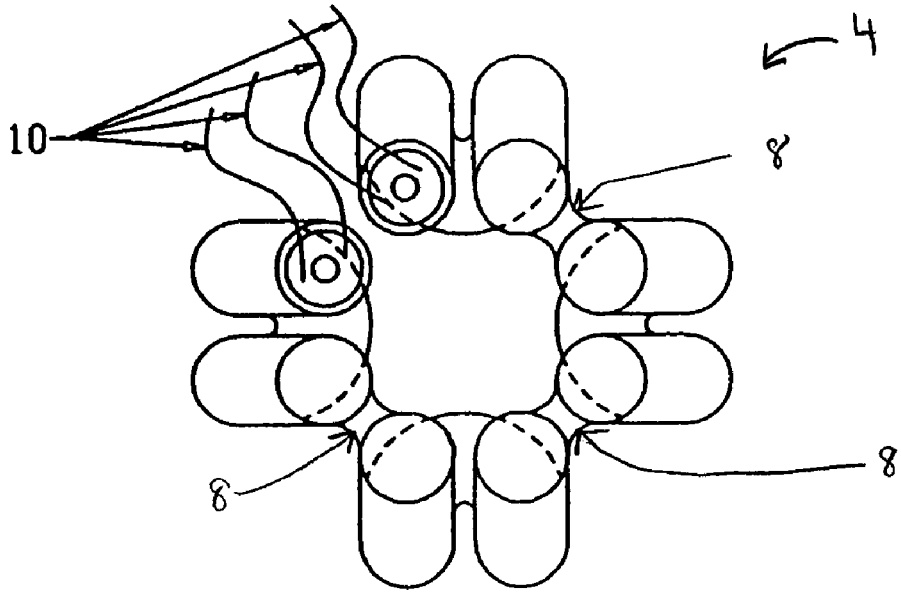
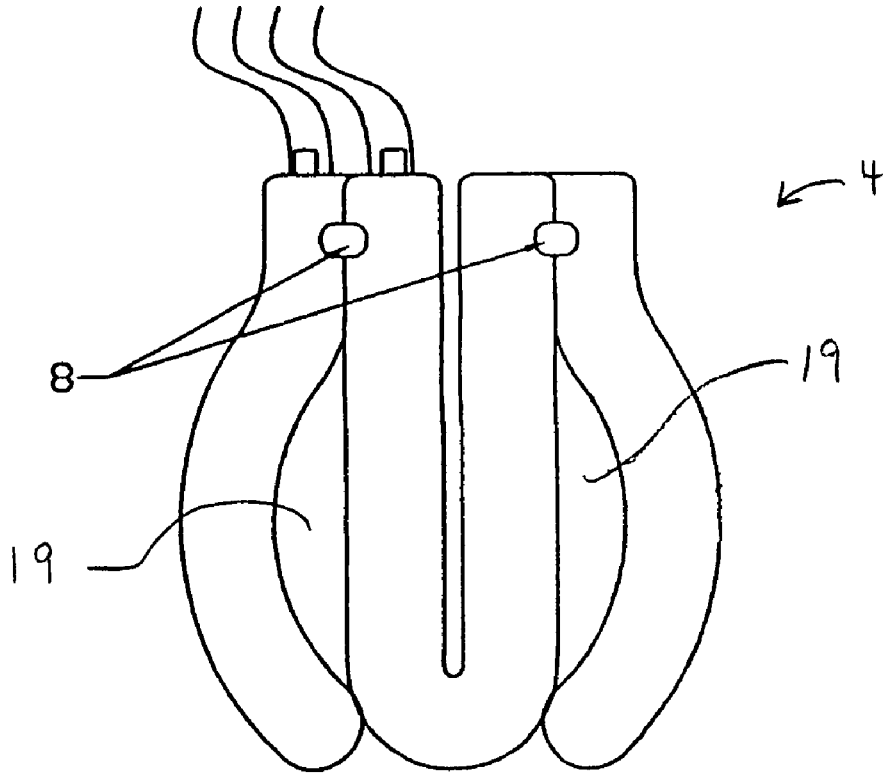
FIG. 2B

FIG. 3A
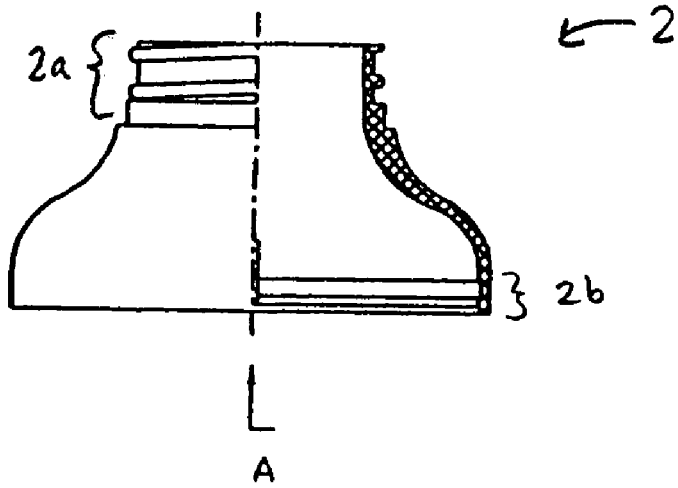
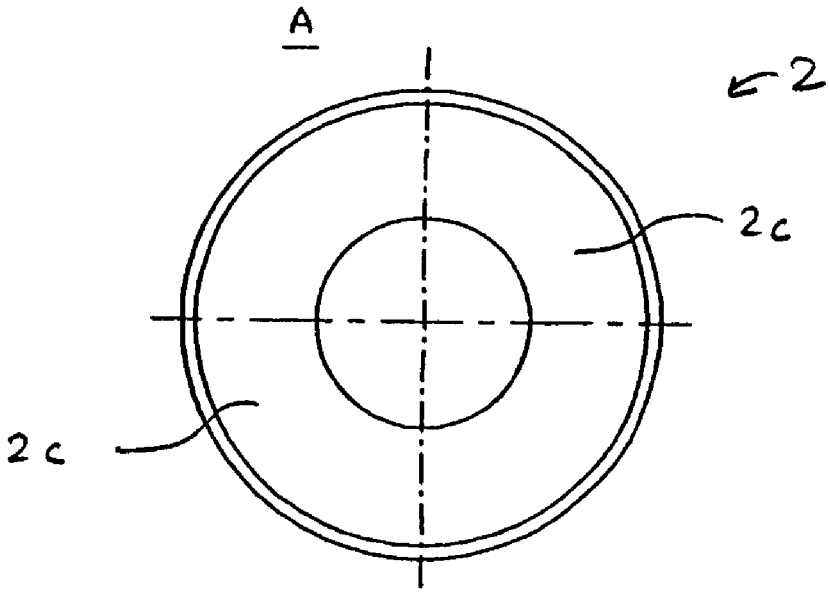
FIG. 3B

FIG. 4A
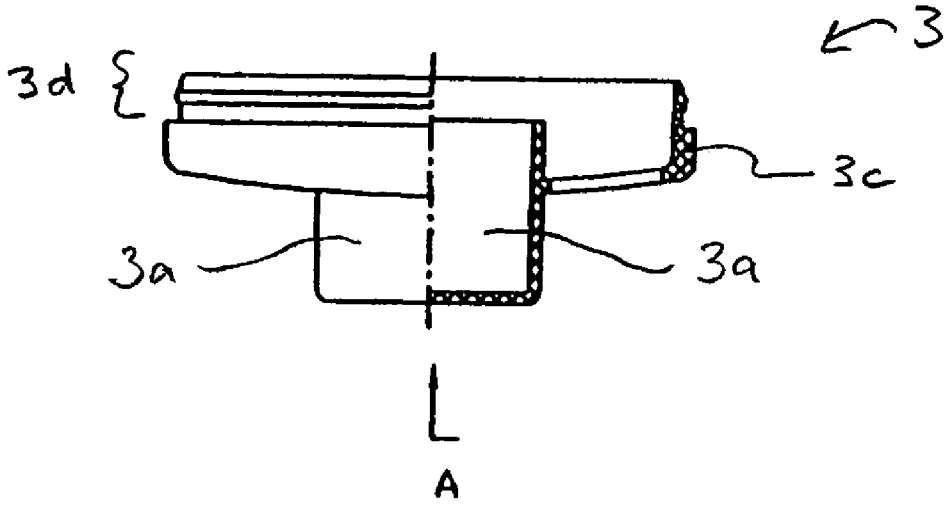
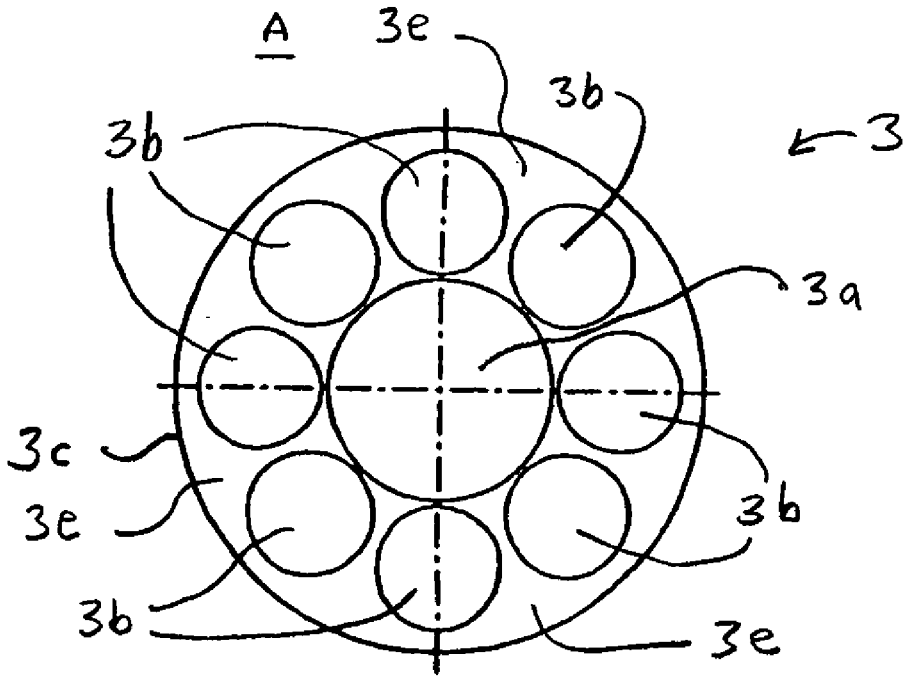
FIG. 4B

ELECTRONIC ENERGY-SAVING FLUORESCENT LAMP OF ULTRA-SHORT CHAYOTE-SHAPED COMPACT TYPE

CROSS REFERENCE TO RELATED APPLICATION

This application claims priority of Chinese Patent Application No. CN03222136.3, filed May 26, 2003, entitled "Ultra-Short Chayote-Like Compact Electronic Energy-Saving Fluorescent Lamp", the entire disclosure of which is incorporated herein by reference.

BACKGROUND OF THE INVENTION

This utility model relates to illuminating lamps, in particular to an ultra-short Chayote-like compact electronic energy-saving fluorescent lamp.

The existing compact electronic energy-saving fluorescent lamps (hereinafter referred to as CFL) with medium and low power smaller than 24 W have basically a column structure in their structural configuration, e.g., U-shape, N-shape, H-shape, the shape of double screw bolt, etc. These existing CFL's have a cylindrical source of light in common, meanwhile the lower cover used to secure the luminous tube in these lamps is of planar construction. The electronic ballast is usually assembled by separate type components. These separate type components (including a current limiting inductor with larger size occupying relatively larger space) are totally mounted on the component side of the Printed Circuit Board (PCB), making the upper and lower covers for receiving the electronic ballast have larger size. Therefore, such a CFL has many disadvantages. One of the disadvantages is the light utilization rate is much lower because the light sent out from the inside surface of the luminous tube is kept out by the near and the opposite luminous tubes. Another disadvantage is the heat generated by the luminous tubes is difficult to be emitted because the luminous tubes of the fluorescent lamp are abutted against one another. Thus, a considerable amount of heat is accumulated, resulting in too high temperature in the working area of the luminous tube and the luminous efficiency is reduced. An additional disadvantage is the luminous tube is longer.

SUMMARY OF THE INVENTION

Based on the full analysis of the CFL's with power smaller than 24 W, the present invention eliminates or decreases their deficiencies, provides solutions for solving these problems and implements the corresponding technical measures which, in one embodiment, results in a Chayote-like compact electronic energy-saving fluorescent lamp (hereinafter referred to as Chayote-like lamp).

In one embodiment, the Chayote-like lamp comprises a base, an upper cover, a lower cover, a luminous tube combination or luminous tube and an electronic ballast. The luminous tube is formed by bridge connection of several luminous tubes. The current limiting inductor of the electronic ballast is welded and assembled on the face of the weld of the Printed Circuit Board (PCB). A cylindrical cavity protrudes downward from the bottom center of the lower cover, characterized in that said Chayote-like lamp is formed by assembling several Chayote-like lamp units—finger-shaped luminous tubes bent so as to have a certain curvature and uniformly distributed about the lamp axis. The current limiting inductor welded and assembled on the face of the weld of the Printed Circuit Board (PCB) is placed in a cylindrical cavity protruding downward from the bottom center of the lower cover.

There are several beneficial effects of the present invention. One beneficial effect is that pulling apart the gap (identified in the figures as gap 19) between each unit luminous tube (about six times or more than that of the column structure) causes the light sent out from the inside of the luminous tube to be directly sent out through the adjacent gaps and the opposite gaps. Thereby, the light utilization rate is greatly improved. Another beneficial effect is that, for each unit U-shaped luminous tube of the Chayote-like lamp, the U-shaped luminous tube is bent at a certain curvature into a finger shape. Thereby, the length of the luminous tube is shortened. The length of the luminous tube of the Chayote-like lamp is much shorter compared to the columnar luminous tube with the same power.

Yet another beneficial effect of the present invention is that the cylindrical cavity protrudes downward from the bottom of the lower cover in the Chayote-like lamp for receiving the current limiting inductor. This configuration shortens the length of the upper cover on the basis of decreasing the length of the electronic ballast.

Still another beneficial effect is that the gap between the unit luminous tubes of the Chayote-like lamp becomes larger, which results in sufficient heat emission and lowers the temperature in the working area of the luminous tube. Thus the luminous efficiency of the Chayote-like lamp is greatly improved. Meanwhile, the temperature rise of the electronic ballast can be reduced and thus, the reliability of the Chayote-like lamp is improved, and its service life is prolonged.

The aforementioned and the other objects, features and advantages of the present invention, to those skilled in the art, will be better understood with regard to the following Detailed Description and accompanying figures.

BRIEF DESCRIPTION OF THE FIGURES

FIG. 1A is a front elevation view of one of the finger-shaped unit luminous tubes of the luminous tube combination or luminous tube in one embodiment of the present invention.

FIG. 1B is a side elevation view of the finger-shaped luminous tube of FIG. 1A.

FIG. 1C is a top or plan view of the finger-shaped luminous tube of FIG. 1A.

FIG. 2A is a top or plan view of the luminous tube combination or luminous tube in one embodiment of the present invention.

FIG. 2B is a side elevation view of the luminous tube combination or luminous tube of FIG. 2A.

FIG. 3A is a side elevation view of the upper cover of the lamp in one embodiment of the present invention.

FIG. 3B is a bottom view of the upper cover of FIG. 3A.

FIG. 4A is a side elevation view of the lower cover of the lamp in one embodiment of the present invention.

FIG. 4B is a bottom view of the lower cover of FIG. 4A.

DETAILED DESCRIPTION OF THE INVENTION

Figure 5A:
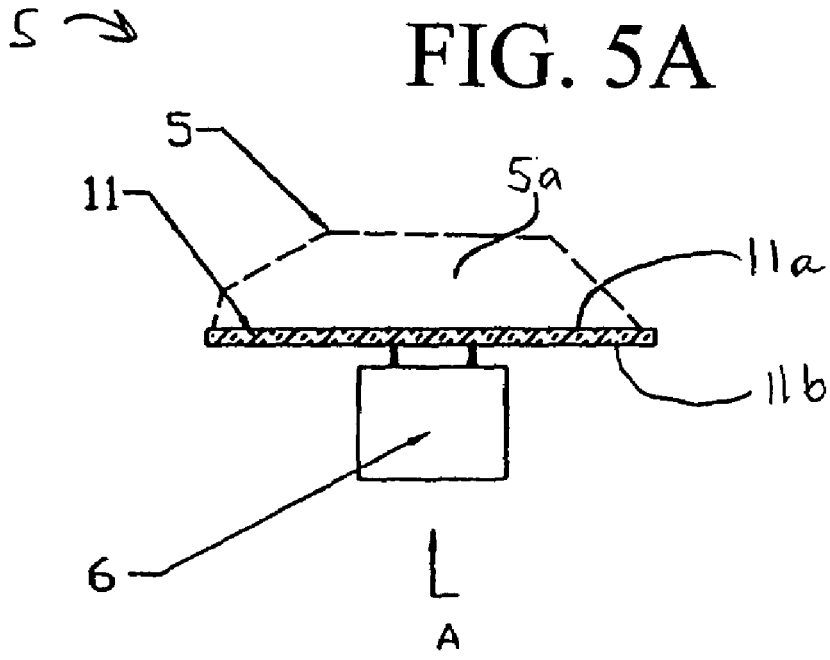
FIG. 5A is a diagrammatic side elevation view of the electronic ballast of the lamp in one embodiment of the present invention.
Figure 5B:
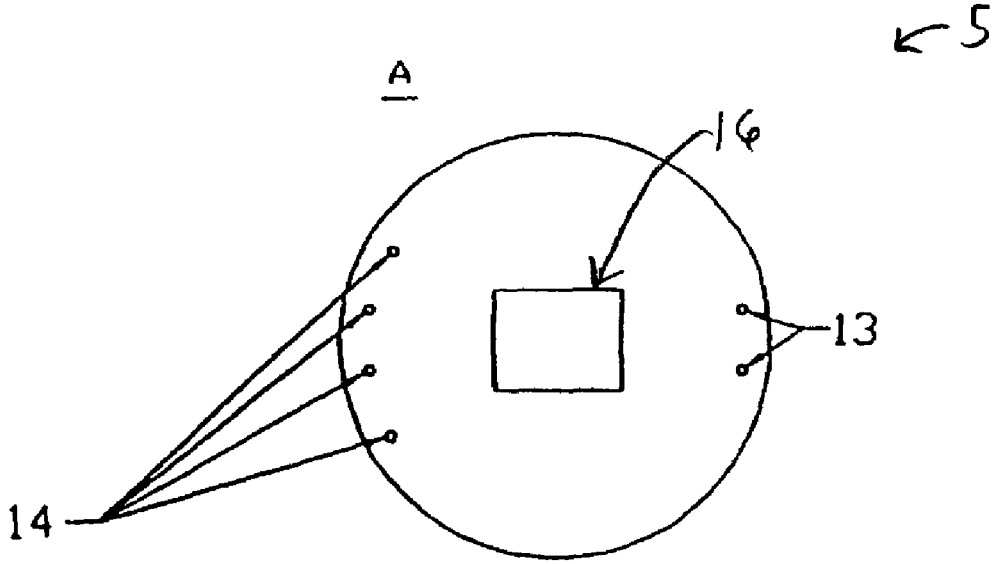
FIG. 5B is a bottom view of the electronic ballast of FIG. 5A.

Referring now to FIGS. 1A–2B, in one embodiment, the luminous tube combination or luminous tube 4 of the lamp 18 (illustrated in FIGS. 6A–6B) is the combination of several unit luminous tubes 7. Each unit luminous tube 7 is formed by bending a U-shaped tube at certain curvature into a finger-shaped unit luminous tube 7 and building up the finger-shaped unit luminous tubes 7 according to the shape of Chayote. According to the different requirements to the designed unit luminous tubes 7, two to five finger-shaped unit luminous tubes 7 with the same curvature are connected in a manner of bridge connection to form a fluorescent lamp with the shape of a Chayote. The tube diameter of the finger-shaped unit luminous tube 7 is in the range of eight to eleven millimeters. The finger-shaped unit luminous tubes 7 are connected to one another in the sequence of connection bridge 8. The filaments 9 (illustrated in FIG. 6B) are cased in both the beginning and the end finger-shaped unit luminous tubes 7, meanwhile rare earth tricolor phosphor powder is uniformly coated on the inner walls of all the finger-shaped unit luminous tubes 7. Also, a certain amount of mercury and inert gas is filled in the luminous tube combination or luminous tube 4 of the Chayote-like lamp 18.

As illustrated in FIGS. 3A–3B, the lamp 18 has an upper cover 2 in one embodiment of the present invention. The upper cover 2 is of a horn shape. There is external thread structure 2*a* on its upper half section and there is annular key and groove structure 2*b* inside of the lower section. The external thread 2*a* is used for connecting and securing the base 1. The key and groove structure 2*b* is used for the mechanical connection of upper cover 2 to lower cover 3. The inner cavity 2*c* of the upper cover 2 is used for receiving electronic ballast 5.

As illustrated in FIGS. 4A–4B, the lamp 18 also has a lower cover 3 in one embodiment of the present invention. The lower cover 3 is of a funnel shape. A cylindrical cavity 3*a* is protruded downward from its bottom center. Eight (or four or six or ten) circular through holes 3*b* are distributed around the cavity 3*a*. A circular peripheral border 3*c* with certain thickness of the lower cover 3 is provided on the outmost edge. Annular key and groove 3*d* are located on the upper part of the peripheral border 3*c*. The protruded cylindrical cavity 3*a* is used for placement of current limiting inductor 6. The circular through holes 3*b* are used for mounting and securing the luminous tube of the Chayote-like lamp 18. The portion 3*e* between the peripheral border 3*c* and the cavity 3*a* is used for filling the securing glue. The annular key and groove 3*d* is used for the mechanical connection to the upper cover 2.

In one embodiment, the lamp 18 also includes an electronic ballast 5, as illustrated. The electronic ballast 5 comprises a Printed Circuit Board (PCB) 11, current limiting inductor 6 and several resistors, capacitors, diodes, triodes, etc. (not shown). The upper surface 11*a* of the PCB 11 is the face of component and its lower surface 11*b* is the face of weld. The electronic ballast 5 defines a space 5*a* for positioning the resistors, capacitors, diodes, triodes, etc. These components are welded and assembled on the face 11*a* of component 11. The current limiting inductor 6 is welded and assembled on the face 11*b* of the weld. In addition, two input junction points 13 and four output junction points 14 are also disposed on PCB 11. The input junction points 13 are electrically connected to power supply connecting wire 12 so as to provide the AC power supply to the electronic ballast 5. The four output junction points 14 are electrically connected to the filament outlet 10 of the luminous tube combination or luminous tube 4 of the Chayote-like lamp 18 so as to provide high frequency voltage and current to the luminous tube combination or luminous tube 4 of the Chayote-like lamp 18 and two sets of filaments 9.

Figure 6A:
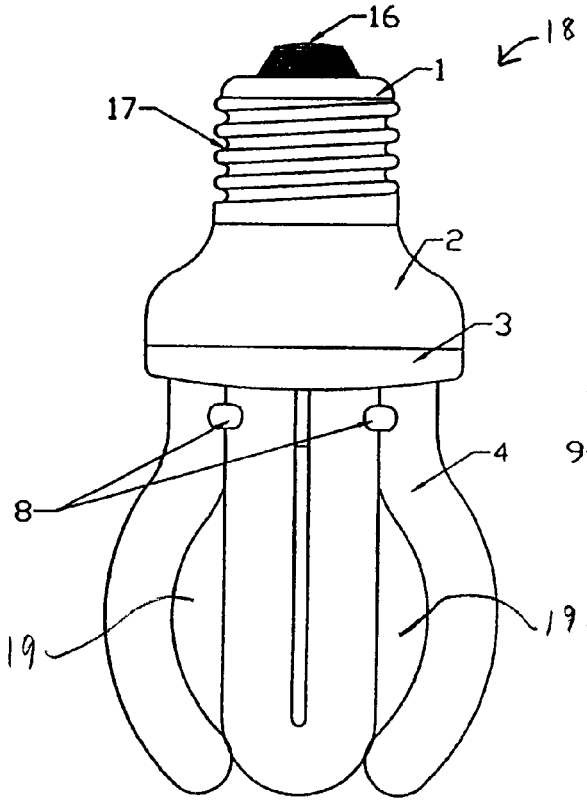
FIG. 6A is a side elevation view of the lamp in one embodiment of the present invention.
Figure 6B:
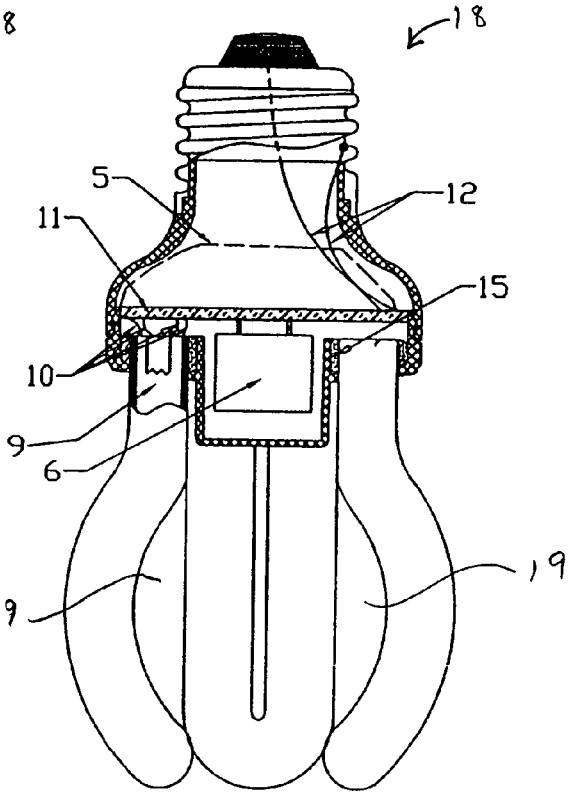
FIG. 6B is a side elevation view of the lamp diagrammatically illustrating the inner components of the lamp in one embodiment of the present invention.

As illustrated in FIGS. 6A and 6B, in one embodiment the Chayote-like lamp 18 includes a base 1, an upper cover 2, a lower cover 3, a luminous tube combination 4 of the Chayote-like lamp 18 and an electronic ballast 5. Their connection is divided into electrical connection and mechanical connection. The electrical connection includes the electrical connection of one end of the two power supply connecting wires 12 of the base 1 to the center point of the base 1 and the thread portion 17, respectively. The electrical connection also includes the other end of the wires 12 being connected to the two input junction points 13, respectively. In this electrical connection, the four output junction points 14 on PCB 11 are connected to the terminals of the four filament outlets 10 of the Chayote-like lamp 18.

The mechanical connection of the lamp 18 includes: (a) the connection of base 1 to upper cover 2; (b) the connection of lower cover 3 to the luminous tube combination or luminous tube 4 of the Chayote-like lamp 18; and (c) the connection of upper cover 2 to lower cover 3 after the electrical connection. In the case of (a), the base 1 and upper cover 2 are connected by thread and clasped after they are screwed down. In the case of (b), the upper one end of the luminous tube combination 4 of the Chayote-like lamp 18 is inserted into the circular through holes 3*b* of the lower cover 3 and their joint is fixed using securing glue. In the case of (c), this connection is located in the cylindrical cavity formed after the current limiting inductor 6 is placed into the lower cover 3. The electronic ballast 5 falls into the lower cover 3 and, at the same time, the upper cover 2 is used to cover the electronic ballast 5. The upper cover 2 and the lower cover 3 are tightly connected to one another through annular key groove.

Because the luminous tube combination 4 of the present invention has a shape of a Chayote, a cylindrical cavity is protruded from the center of the bottom of the lower cover 3 towards the direction of the luminous tube combination or luminous tube 4. The current limiting inductor 6 is welded and assembled on the face 11*b* of weld of the PCB board 11. The special structures mentioned above bring the Chayote-like lamp advantages e.g., novel structure, ultra-short size, small and exquisite, higher luminous efficiency, higher reliability, longer service life and wide application for the illumination in all places, particularly suitable for the lamps and lanterns with covers.

The foregoing example is only used for the description of the present invention, other than the limit to the present invention. To those skilled in the art, variations or modifications can be made without departing from the spirit and the range of the present invention. Therefore, all equivalent technical solutions shall belong to the category of the present invention and shall be covered by the claims.

The following is a list of terms used herein and the identification numbers corresponding to such terms:

base 1 upper cover 2 lower cover 3 luminous tube combination or luminous tube 4 (of the lamp 18)

electronic ballast 5
current limiting inductor 6
finger-shaped unit luminous tube 7
connection bridge 8
filament 9
filament outlet 10
Printed Circuit Board (PCB) 11
power supply connecting wire 12
input junction point 13
output junction point 14
connection securing glue 15
center point 16 (of the base 1)
thread 17 (of the base 1)
Chayote-like lamp 18
gap 19

The invention is claimed as follows:

1. A fluorescent lamp comprising:

a base;

a plurality of luminous tubes, each of the luminous tubes having:

(a) a first curvature forming a bend defining a U-shape;

(b) a plurality of ends adjacent to one another;

(c) a middle region positioned between the bend and the ends; and (d) a second curvature which offsets the middle region from the bend and the ends;

a bridge connection connecting each of the luminous tubes to at least one of the other luminous tubes;

an electronic ballast electrically connected to the luminous tubes; and a mounting member connected to the base, the mounting member holding the luminous tubes in such a position so that:

(a) the ends of each of the luminous tubes are adjacent to the ends of another one of the U-shaped luminous tubes; and (b) the bend of each of the luminous tubes is adjacent to the bend of another one of the U-shaped luminous tubes.

2. The fluorescent lamp of claim 1, which includes a cover member connected to the base, the mounting member being included within the cover member.

3. The fluorescent lamp of claim 1, wherein each of the luminous tubes has a finger-shape defined by the second curvature.

4. The fluorescent lamp of claim 1, wherein the luminous tubes form a Chayote-like shape when held by the mounting member.

5. A fluorescent lamp comprising:

a base;

a plurality of luminous tubes, each of the luminous tubes having:

(a) a first curvature defining a bend;

(b) a plurality of ends adjacent to one another;

(c) a middle region positioned between the bend and the ends; and (d) a second curvature which offsets the middle region from the bend and the ends;

a bridge connection connecting each of the luminous tubes to at least one of the other luminous tubes;

an electronic ballast electrically connected to the luminous tubes; and a cover member connected to the base, the cover member holding the luminous tubes in such a position so that:

(a) the ends of each of the luminous tubes are adjacent to the ends of another one of the luminous tubes;

(b) the bend of each of the luminous tubes is adjacent to the bend of another one of the luminous tubes;

(c) each of the middle regions of the luminous tubes is opposed to another one of the middle regions so as to define a perimeter of an inner space;

(d) a distance separates the bends of the luminous tubes from the ends of the luminous tubes, the distance defining a length of the inner space; and (e) a gap separates each of the luminous tubes, the gap being greatest at the middle regions.

6. The fluorescent lamp of claim 5, wherein each of the luminous tubes has a finger-shape defined by the second curvature.

7. The fluorescent lamp of claim 5, wherein the luminous tubes form a Chayote-like shape when held by the mounting member.

8. The fluorescent lamp of claim 5, wherein the electronic ballast includes a current limiting inductor, and the inner space includes a cavity for placement of the current limiting inductor.

9. The fluorescent lamp of claim 8, wherein the electronic ballast includes a printed circuit board having a first side facing the base and a second side facing the inner space, the current limiting inductor being connected to the second side.

10. The fluorescent lamp of claim 5, wherein the gaps have dimensions sufficient to facilitate transmission of light from the luminous tubes.

11. The fluorescent lamp of claim 5, wherein the gaps have dimensions sufficient to facilitate transfer of heat from the luminous tubes.

12. The fluorescent lamp of claim 5, wherein each of the luminous tubes has a diameter in the range of eight millimeters to eleven millimeters.

13. The fluorescent lamp of claim 5, wherein a quantity of the luminous tubes is in the range of two to five.

14. The fluorescent lamp of claim 5, wherein the fluorescent lamp has a power of less than twenty-four watts.

15. A compact fluorescent lamp having an ultra-short and Chayote-like configuration, the compact fluorescent lamp comprising:

a base having a plurality of threads;

an upper cover connected to the base;

a lower cover connected to the upper cover;

a luminous tube connected to the lower cover, the luminous tube being formed by bridge connection of a plurality of unit luminous tubes, each of the unit luminous tubes having: (a) a bend defining a U-shape; and (b) a curvature defining a finger-shape, the unit luminous tubes being disposed so as to form a shape of Chayote for the luminous tube; and an electronic ballast electrically connected to the luminous tube.

16. The compact fluorescent lamp of claim 15, wherein each of the unit luminous tubes has a diameter in a range of eight millimeters to eleven millimeters.

17. The compact fluorescent lamp of claim 15, wherein the configuration of the luminous tube has a profile which substantially conforms to a longitudinal section of Chayote.

18. The compact fluorescent lamp of claim 15, which includes a quantity of the luminous tube units in a range of two to five.

19. A method for manufacturing a compact fluorescent lamp comprising:

(a) providing a base having a plurality of threads;

(b) providing a plurality of luminous tubes each of which has a plurality of ends and a middle region;

(c) forming a bend in each of the luminous tubes thereby causing the luminous tubes to have a U-shape;

(d) forming a curvature in each of the luminous tubes thereby causing the middle region to be offset from a plane passing through the ends and the bend;

(e) coupling a mounting member to the base;

(f) coupling the ends of the luminous tubes to the mounting member in such a fashion that:

(i) the ends of each of the luminous tubes are positioned adjacent to the ends of another one of the luminous tubes;

(ii) the bend of each of the luminous tubes is adjacent to the bend of another one of the luminous tubes;

(iii) each of the middle regions of the luminous tubes is opposed to another one of the middle regions so as to define a perimeter of an inner space;

(iv) a distance separates the bends of the luminous tubes from the ends of the luminous tubes, the distance defining a length of the inner space; and (v) a gap separates each of the luminous tubes, the gap being greatest at the middle regions;

(g) using a bridge connection to connect each of the luminous tubes to at least one of the other luminous tubes;

(h) electrically connecting an electronic ballast to the luminous tubes, the electronic ballast having a current limiting inductor; and (i) positioning at least a portion of the current limiting inductor within the inner space.

20. The method of claim 19, wherein step (d) includes the step of causing each of the luminous tubes to have a finger-like shape.

21. The method of claim 20, wherein step (f) includes the step of causing the luminous tubes to form a Chayote-like shape.

* * * * *